US011882950B2

(12) United States Patent
Bowen et al.

(10) Patent No.: US 11,882,950 B2
(45) Date of Patent: Jan. 30, 2024

(54) BEVERAGE CONTAINER CARRIER

(71) Applicant: BevMate, LLC, Tifton, GA (US)

(72) Inventors: William D. Bowen, Enigma, GA (US); Michael C. Bowen, Tifton, GA (US); John W. Bowen, Tifton, GA (US)

(73) Assignee: BevMate, LLC, Tifton, GA (US)

( * ) Notice: Subject to any disclaimer, the term of this patent is extended or adjusted under 35 U.S.C. 154(b) by 440 days.

(21) Appl. No.: 17/345,629

(22) Filed: Jun. 11, 2021

(65) Prior Publication Data

US 2021/0401207 A1 Dec. 30, 2021

Related U.S. Application Data

(60) Provisional application No. 63/043,228, filed on Jun. 24, 2020.

(51) Int. Cl.

| | |
|---|---|
| ***A47G 23/02*** | (2006.01) |
| ***B65D 25/20*** | (2006.01) |
| ***B65D 25/10*** | (2006.01) |

(52) U.S. Cl.

CPC ..... *A47G 23/0216* (2013.01); *B65D 25/101* (2013.01); *B65D 25/20* (2013.01); *B65D 2313/04* (2013.01)

(58) Field of Classification Search

CPC ..... A47G 23/0216; A47G 2023/0283; A47G 2023/0291; B65D 25/101; B65D 25/20; B65D 2313/04; B65D 25/107

See application file for complete search history.

(56) References Cited

U.S. PATENT DOCUMENTS

| | | | | |
|---|---|---|---|---|
| 2,661,610 | A * | 12/1953 | Treff | A47G 23/0216 248/145.3 |
| 8,251,247 | B1 | 8/2012 | Breckner | |
| D962,716 | S * | 9/2022 | Bowen | D7/529 |
| 2018/0008072 | A1* | 1/2018 | Paige | A47G 23/0241 |
| 2020/0253406 | A1* | 8/2020 | Mills | A47G 23/0266 |
| 2020/0383526 | A1* | 12/2020 | Mosseri | H04R 1/028 |
| 2021/0039857 | A1* | 2/2021 | Stewart | B65D 1/36 |
| 2021/0145196 | A1* | 5/2021 | Moody | B65D 81/3881 |
| 2021/0267394 | A1* | 9/2021 | Nelson | B65D 81/3886 |
| 2022/0048691 | A1* | 2/2022 | Adjeleian | B65D 81/3879 |

OTHER PUBLICATIONS

Master Magnetics Cup Caddy product photos.

* cited by examiner

*Primary Examiner* — Don M Anderson
(74) *Attorney, Agent, or Firm* — H. Brock Kolls

(57) ABSTRACT

This present invention relates a beverage container carrier comprising a cylindrical vessel receiver for receiving a beverage container, one or more of a tension tab, and one or more of a tension fin. When a beverage container is inserted into the cylindrical vessel receiver it contacts the tension fin. The tension fin and tension tab flex outward creating space within the cylindrical vessel receiver for the beverage container and applying retaining pressure to the beverage container holding it securely within the cylindrical vessel receiver. In exemplary embodiments, the beverage container carrier further comprises a handle slot proximate to the open-top rim for receiving the beverage container handle, and an attachment panel having concealed magnet retention slots. One or more magnets are secured in each of the magnet retention slots and orientated such that the magnets secure the beverage container carrier to ferrous metal objects.

20 Claims, 12 Drawing Sheets

BEVERAGE CONTAINER CARRIER

CROSS-REFERENCE TO RELATED APPLICATIONS

This application contains subject matter which is related to the subject matter of the following application. The below-listed application is hereby incorporated herein by reference in its entirety:

This is a U.S. non-provisional application that claims the benefit of a U.S. provisional application, Ser. No. 63/043,228, inventor William D. Bowen et al., entitled "MAGNETIC VESSEL HOLDER", filed Jun. 24, 2020.

TECHNICAL FIELD OF THE INVENTION

This invention relates to a beverage container carrier for cups, cans, mugs, beakers, and other vessels containing beverages. More particularly, the invention relates to a beverage container carrier that can be attached and temporarily affixed to ferrous metal surfaces. The beverage container carrier can hold hot or cold beverage containers and is designed for use with an upright beverage container.

BACKGROUND OF THE INVENTION

Cup holders are used to secure and support beverage containers without the constant physical aid or assistance of the user. Cup holders that are meant to secure and support beverage containers during transit from one location to another are typically incorporated into the design and assembly of the respective transportation systems, such as cup holders that are found within automobiles, golf carts, and certain outdoor equipment such as tractors and utility terrain vehicles. Due to the nature of their design, these cup holders are generally fixed in a permanent position within their host vehicle or machine, which means it is impractical or virtually impossible to remove the cup holders from their host vehicle or machine and transport them to a secondary or remote location. As a result, cup holders that are used to secure and support beverage containers during travel are limited in utility to those applications during which the user wishes to utilize the cup holder and is also willing or able to simultaneously operate the host vehicle or machine. Additionally, cup holders that are used to secure and support beverage containers during travel are typically rigid, inflexible, and fixed in size due to the nature of their incorporation into host vehicle or mechanical assemblies. Such cup holders do not represent dynamic systems that can adapt to sizing variations between beverage containers, and as such, they are typically only able to accommodate an extremely limited range of beverage container sizes.

Cup holders that are designed as standalone, independent, transportable systems capable of securing and supporting beverage containers currently lack features that are necessary for the optimal functionality and utility of these systems. For instance, the autonomous, transportable cup holder US Patent number US8251247B1 is equipped with a base having magnetic properties and a metal body accommodating a cylindrical core. The latter feature prohibits the cup holder from accommodating any beverage container whose maximum outside diameter is greater than the cup holder's minimum inside diameter, thus limiting the utility of the system to those users whose beverage container is narrower than the cylindrical core. Additionally, the placement of a magnetic surface on the cup holder's base means that utility is only derived from this feature if a ferrous, horizontal host surface is available. This requirement inherently reduces the potential utility of this feature, considering that horizontal surfaces typically support beverage containers without the assistance of magnetism.

Other cup holder designs that are based on the principle of independence and transportability also lack certain key features that are necessary for optimal utility and functionality. For instance, CUP CADDY (sold by Master Magnetics) incorporates a vertical, magnetized ridge running the length of its rear wall in the design of its system. This may improve its utility, as many users require that a magnetized, transportable cup holder be able to affix to ferrous vertical surfaces that do not naturally provide support for a beverage container. However, CUP CADDY is designed to feature a fixed inner diameter between the static, inflexible, and non-movable nonresponsive vertical walls that support and secure beverage containers, which prohibits the accommodation of any beverage containers whose maximum outer diameter exceeds the minimum inner diameter of CUP CADDY'S support walls. Additionally, any beverage container whose maximum outer diameter is less than CUP CADDY'S minimum inner diameter will only be in direct contact with the base surface of CUP CADDY when placed in the unit. This lack of constant contact with CUP CADDY'S vertical support walls means that beverage containers inserted into CUP CADDY will be prone to sliding, rocking, and bouncing between CUP CADDY'S vertical support surfaces during any instances in which CUP CADDY is magnetically affixed to a surface that is in motion. Such limitation negatively impacts the utility of the system for a broad spectrum of potential users.

For these reasons and shortcomings as well as other reasons and shortcomings, there is a long-felt need that gives rise to the present invention.

SUMMARY OF THE INVENTION

The shortcomings of the prior art are overcome and additional advantages are provided through the provision of a beverage container carrier comprising a cylindrical vessel receiver having a left side, a right side, a front side, a backside, an interior surface, an exterior surface, a bottom panel, and an open-top rim for receiving a beverage container.

One or more of a tension tab having an interior tab surface and an exterior tab surface. The tension tab is integrally formed along an attachment edge proximate to the open-top rim of the cylindrical vessel receiver. The tension tab is sized to create an air gap between the cylindrical vessel receiver and sides and bottom of the tension tab allowing the tension tab to flex outward.

One or more tension fin having a top fin end and a bottom fin end are integrally formed on the interior tab surface of the tension tab. The tension fin is curvilinear in shape wider at the bottom fin end with a taper at the top fin end that terminates at the interior surface of the cylindrical vessel receiver. When a beverage container is inserted into the cylindrical vessel receiver it contacts the tension fin. The tension fin and tension tab flex outward creating space within the cylindrical vessel receiver for the beverage container and applying retaining pressure to the beverage container holding it securely within the cylindrical vessel receiver.

Additional shortcomings of the prior art are overcome and additional advantages are provided through the provision of a beverage container carrier comprising a cylindrical vessel receiver having a left side, a right side, a front side, a backside, an interior surface, an exterior surface, a bottom panel, and an open-top rim for receiving a beverage container.

A handle slot is integrally formed in the front side of the cylindrical vessel receiver. The handle slot is open proximate to the open-top rim for receiving the beverage container handle. The handle of the beverage container slides into the handle slot when the beverage container is inserted into the cylindrical vessel receiver.

One or more of a tension tab having an interior tab surface and an exterior tab surface. The tension tab is integrally formed along an attachment edge proximate to the open-top rim of the cylindrical vessel receiver, the tension tab is sized to create an air gap between the cylindrical vessel receiver and sides and bottom of the tension tab allowing the tension tab to flex outward.

One or more tension fin having a top fin end and a bottom fin end are integrally formed on the interior tab surface of the tension tab. The tension fin is curvilinear in shape wider at the bottom fin end with a taper at the top fin end that terminates at the interior surface of the cylindrical vessel receiver. When a beverage container is inserted into the cylindrical vessel receiver it contacts the tension fin. The tension fin and tension tab flex outward creating space within the cylindrical vessel receiver for the beverage container and applying retaining pressure to the beverage container holding it securely within the cylindrical vessel receiver.

Additional shortcomings of the prior art are overcome and additional advantages are provided through the provision of a beverage container carrier comprising a cylindrical vessel receiver having a left side, a right side, a front side, a backside, an interior surface, an exterior surface, a bottom panel, and an open-top rim for receiving a beverage container.

An attachment panel is integrally formed on the backside of the cylindrical vessel receiver, the attachment panel having concealed one or more of a magnet retention slot.

One or more of a magnet is secured in each of the magnet retention slot and orientated such that the magnet secures the beverage container carrier to ferrous metal objects.

One or more of a tension tab having an interior tab surface and an exterior tab surface. The tension tab is integrally formed along an attachment edge proximate to the open-top rim of the cylindrical vessel receiver. The tension tab is sized to create an air gap between the cylindrical vessel receiver and sides and bottom of the tension tab allowing the tension tab to flex outward.

One or more tension fin having a top fin end and a bottom fin end are integrally formed on the interior tab surface of the tension tab. The tension fin curvilinear in shape wider at the bottom fin end with a taper at the top fin end that terminates at the interior surface of the cylindrical vessel receiver. When a beverage container is inserted into the cylindrical vessel receiver it contacts the tension fin. The tension fin and tension tab flex outwardly creating space within the cylindrical vessel receiver for the beverage container and applying retaining pressure to the beverage container holding it securely within the cylindrical vessel receiver.

Additional features and advantages are realized through the design of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1A:
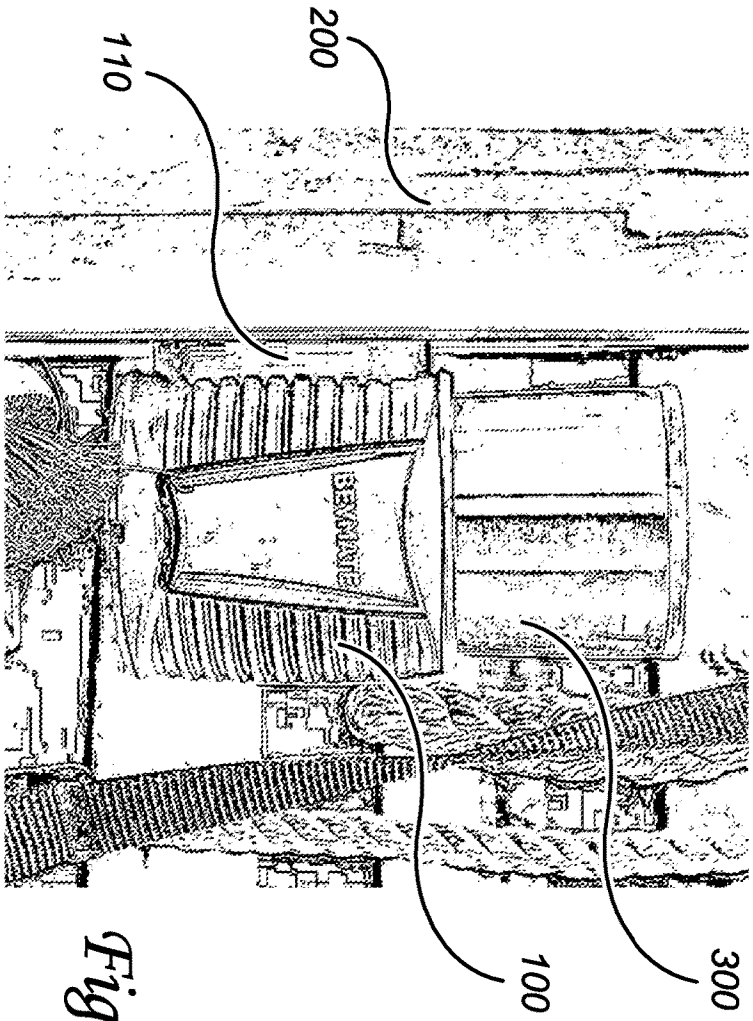
FIGS. 1A-1D illustrates examples of a beverage container carrier carrying various types of beverage containers.

The detailed description explains the preferred embodiments of the invention, together with advantages and features, by way of example with reference to the drawings.

DETAILED DESCRIPTION OF THE INVENTION

An advantage in the present invention is that the beverage container carrier is designed to support and stabilize upright beverage containers of varying sizes while magnetically affixing to ferrous vertical surfaces that may either be stationary or movable.

Another advantage in the present invention is that the beverage container carrier includes dynamic and flexible vertical support walls called tension tabs that have tension fins so that the beverage container carrier can accommodate beverage containers whose maximum outer diameter is greater than, or less than, the minimum inner diameter of the beverage container carrier vertical support walls. In addition, the tension tabs are constructed in such a way as to exert constant lateral pressure on the beverage container to prevent sliding, rocking, or bouncing out of the beverage container carrier such beverage containers while the beverage container carrier is affixed to a ferrous metal surface that is in motion, such as a vehicle.

Referring to FIGS. 1A-1D here are illustrated examples of the beverage container carrier 100 carrying various types of beverage containers. In an exemplary embodiment, the beverage container carrier 100 is oversized relative to the range of beverage containers 300 it can hold that includes cups, bottles, cans, thermoses, and/or other beverage containers 300. The beverage container carrier 100 is constructed from a highly durable and rigid material such as a synthetic polymer, plastic, or polyethylene vinyl chloride, or other suitable materials. The beverage container carrier 100 is designed in a generally cylindrical fashion referred to for disclosure purposes as cylindrical vessel receiver 132 in the drawings. The cylindrical vessel receiver 132 forms the beverage container carrier 100 size and dimensional structure and includes a bottom panel 134, vertical support walls, and an open-top rim.

The beverage container 100 can be manufactured by way of molding, 3D printing, stamping, or by other methods of manufacture, as may be required and/or desired in a particular embodiment.

The cylindrical vessel receiver 132 forms the support walls of the beverage container carrier 100. The cylindrical vessel receiver 132 comprises an open-top rim 106 for receiving a beverage container, a bottom panel 134 having a plurality of drain holes 116, a left side, a right side, a front side, a backside, an interior surface, and an exterior surface.

In an exemplary embodiment, FIG. 1A illustrates a beverage container 300 that is very tall, and having a large diameter, a lid, and absent a handle inserted into the beverage container carrier 100. An attachment panel 110 encloses a plurality of magnets such that when attachment panel 110 is brought proximate to a ferrous metal object 200 the beverage container carrier 100 is held or otherwise secured in place to that ferrous metal object by the magnets 112. Such ferrous metal objects 200 can, for example, and not a limitation, be building structures, workshop vertical surfaces, vehicle panels, and numerous other types and kinds of vertical ferrous metal objects/surfaces.

Figure 1B:
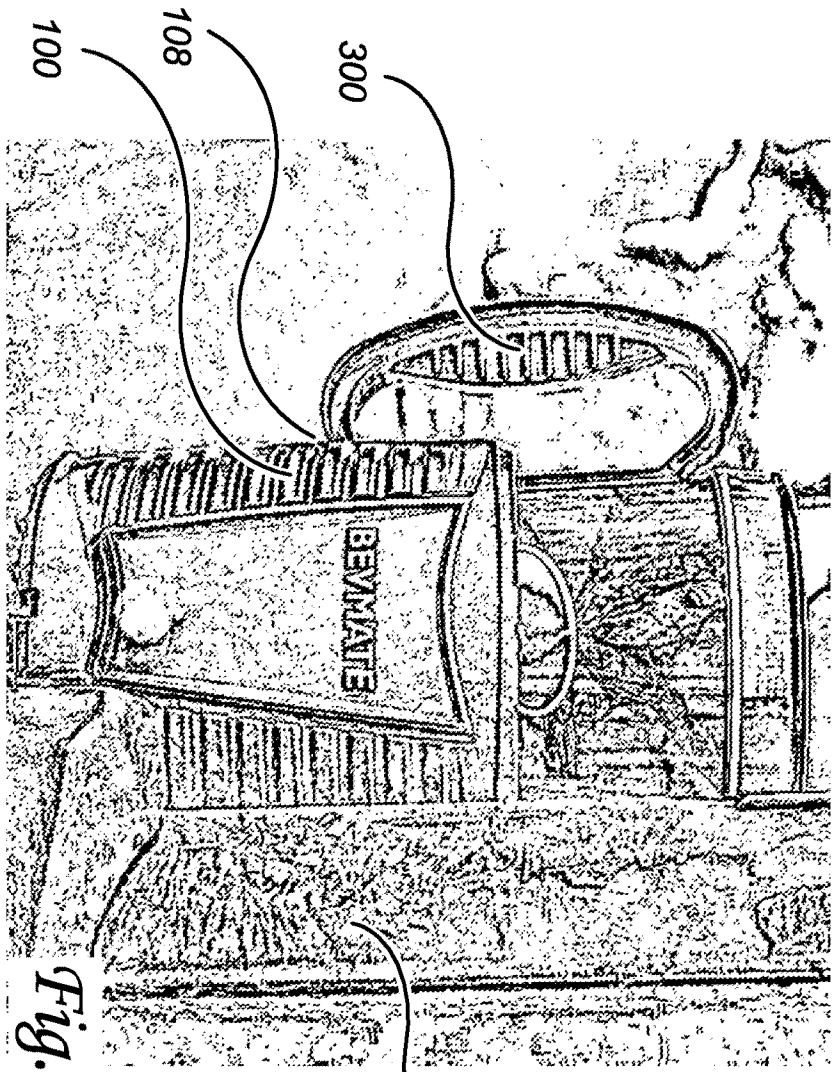

In another exemplary embodiment, FIG. 1B illustrates a beverage container carrier 100 carrying a large beverage container 300 having a handle. The beverage container carrier 100 comprises a handle slot 108 that allows the handle of a beverage container 300 to slide down into the handle slot 108 so that beverage container 300 that has a handle easily fits into the beverage container carrier 100. The handle slot 108 having flared interior edges 142 proximate the open-top rim 106 to make it easier for the user to engage the beverage container 300 handle with the beverage container carrier 100 handle slot 1008 and slide the beverage container 300 and handle into the beverage container carrier 100.

Figure 1C:
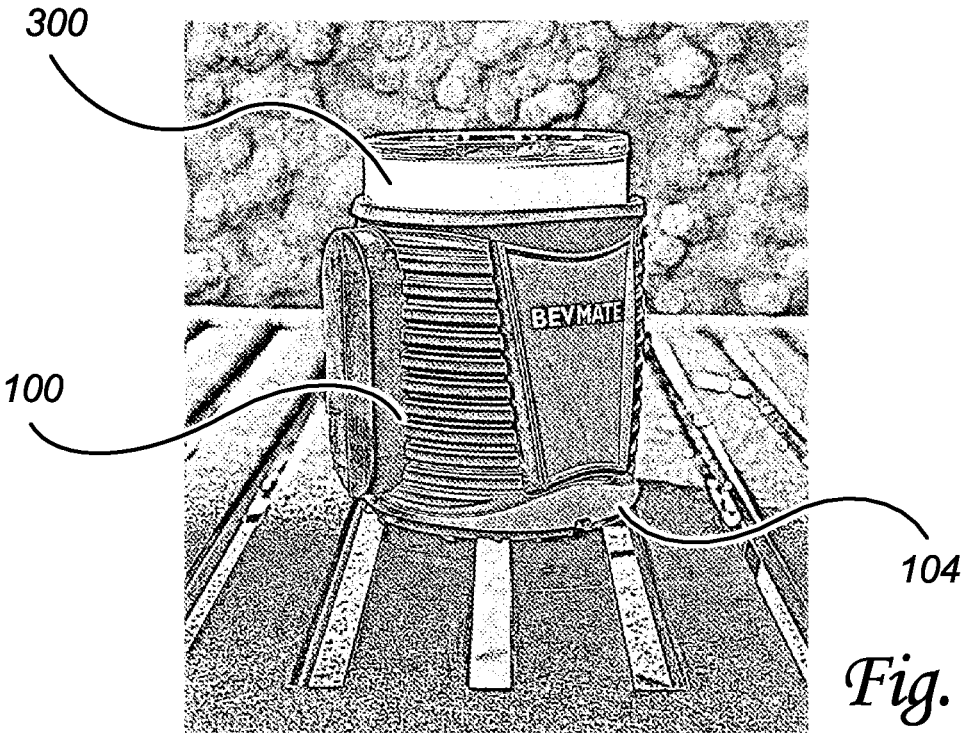
Figure 1D:
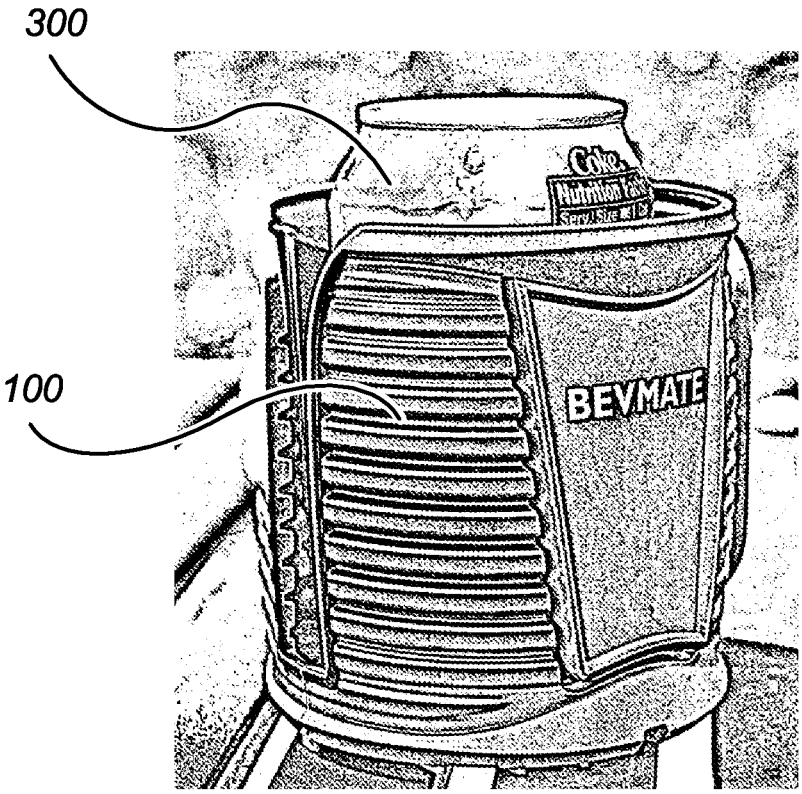

In another exemplary embodiment, FIG. 1C illustrates a very wide diameter beverage container 200 inserted into the beverage container carrier 100. To accommodate beverage containers of different diameters tension tabs 104 disposed on opposing sides of the beverage container carrier 100 are configured to engage the beverage container 300 exterior walls and be displaced outwardly 402 both accommodating and securing the beverage container regardless of the beverage container 300 diameter.

In an exemplary embodiment, the beverage container carrier 100 comprises a cylindrical vessel receiver 132 having an open-top rim for receiving a beverage container 300. The cylindrical vessel receiver 132 provides the structure and basic dimensions of the beverage container carrier 100. The tension tabs 104 are integrally formed proximate to the open-top rim 106 along an attachment edge 126 of the cylindrical vessel receiver 132. The tension tabs 104 are sized to create an air gap 128 between the cylindrical vessel receiver 132 and the sides and bottom of the tension tab allowing the lower portion of the tension tab to flex outward 402. The tension tab 104 can be tapered in design having a longer horizontal attachment edge than the lower horizontal bottom edge. FIG. 1C illustrates the lower portion of the tension tab 104 flexed outward 402. In an exemplary embodiment, tension tabs 104 can be disposed on opposing sides of the cylindrical vessel receiver 132.

In another exemplary embodiment, a beverage can container 300 can be inserted into the beverage container carrier 100. Visually shown in FIG. 1D as being smaller in diameter than the beverage container carrier 100, the tension fins 118 centers and secures the beverage can in the beverage container carrier 100. The tension fins 118 are better illustrated in at least FIG. 10. The tension tabs 104 have one or more tension fin 118 having a top fin end and a bottom fin end that is integrally formed on the interior surface of the tension tab 104. The tension fins 118 are curvilinear in shape wider at the bottom fin end with a taper at the top fin end that terminates at the interior surface of the cylindrical vessel receiver 132.

The tension fins 118 extend from the tension tabs and are sized to engage minimum diameter beverage container 300 when they are inserted into the beverage container carrier 100. When a larger diameter beverage container 300 is inserted into the beverage container carrier 100 the tension fins are spread apart in turn moving the tension tabs 104 outward 402 to accommodate the larger diameter beverage container 300. In this regard, variable diameter beverage containers 300 can be inserted into the beverage container carrier 100 and the tension fins 118 and tension tabs 104 adjust accordingly to center and secure the beverage container 300 within the beverage container carrier 100.

In operation, a user inserts a beverage container 300 into the beverage container carrier 100. The beverage container 300 engages the tension fins 118 flexing the tension tabs 104 outward 402. Once inserted, the tension tabs provide a stabilizing force against the beverage container 300, securing the beverage container 300 in the beverage container carrier 100.

The constant, lateral pressure exerted by the vertical support walls is produced in response to the outward pressure that beverage container 300 exerts on the dynamic and flexible tension tabs 104 and tension fins 118. The utility of this feature is enjoyed without any input from the user other than the placement of beverage container 300 within the beverage container carrier 100.

Figure 3:
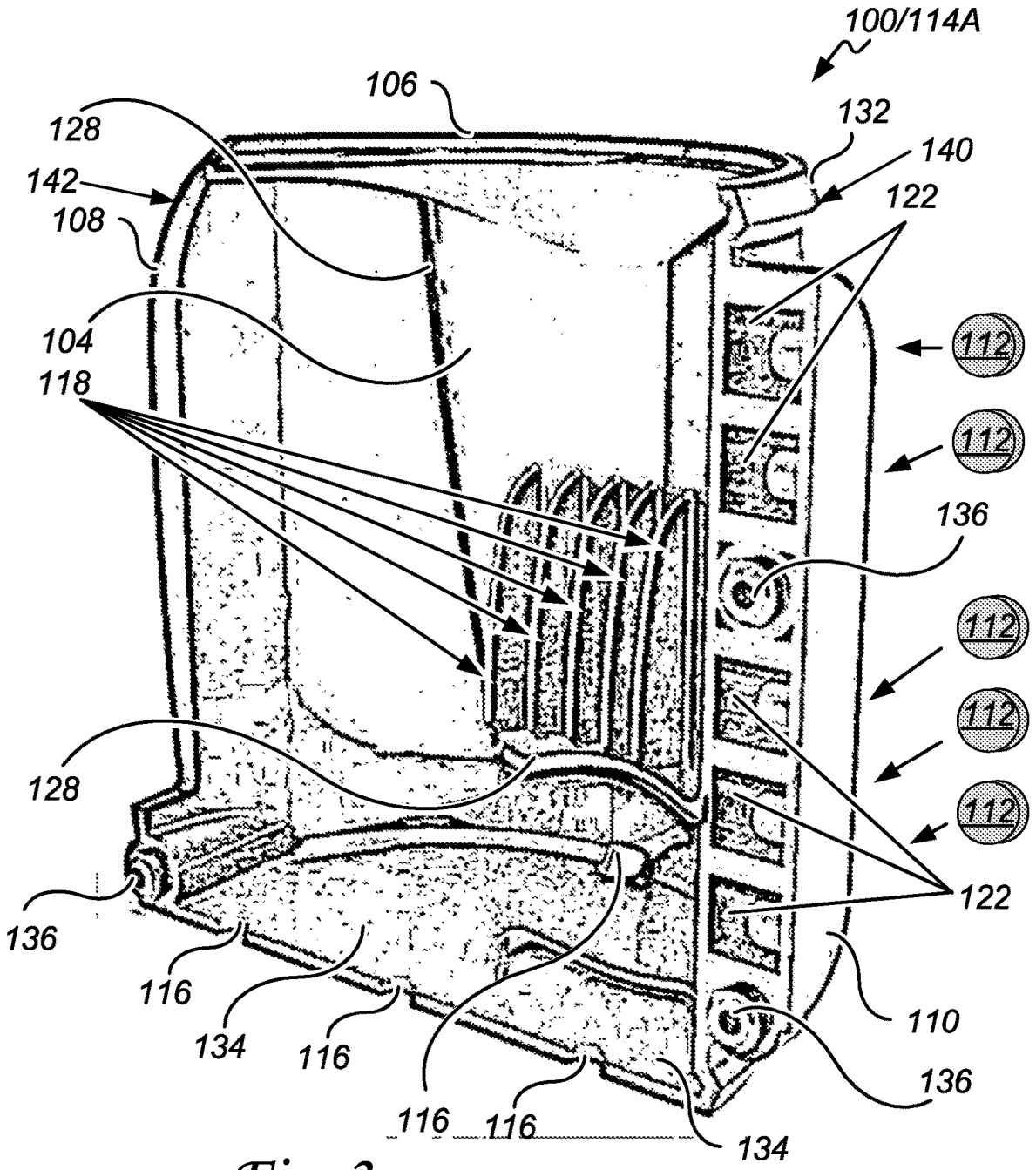
FIG. 3 illustrates one example of a sectional perspective of the invention which shows an internal view of one half of the beverage container carrier and the tension fins that are on the interior side of the tension tab, as well as the inside of the attachment panel including the magnet cavities.

The beverage container carrier 100 possesses an ergonomic design that is adaptable to hold hot and cold beverages of a variety of shapes and sizes. In an exemplary embodiment, for example, and not a limitation, the open-top end 106 can be 4.17 inches wide in diameter, and the height of the beverage container carrier 100 can be 4.17 inches tall, though in other embodiments the dimensions can be different. The handle slot 108 shown in at least FIG. 3 is designed to accept beverage containers that have affixed handles that protrude from the beverage container carrier 100 when placed inside. The open-top end 106 has a flared edge 140 outward to provide enhanced grasp-ability when moving or adjusting the beverage container carrier by way of the user gripping the top flared edge 140 instead of the middle of the beverage container carrier 100.

Figure 2:
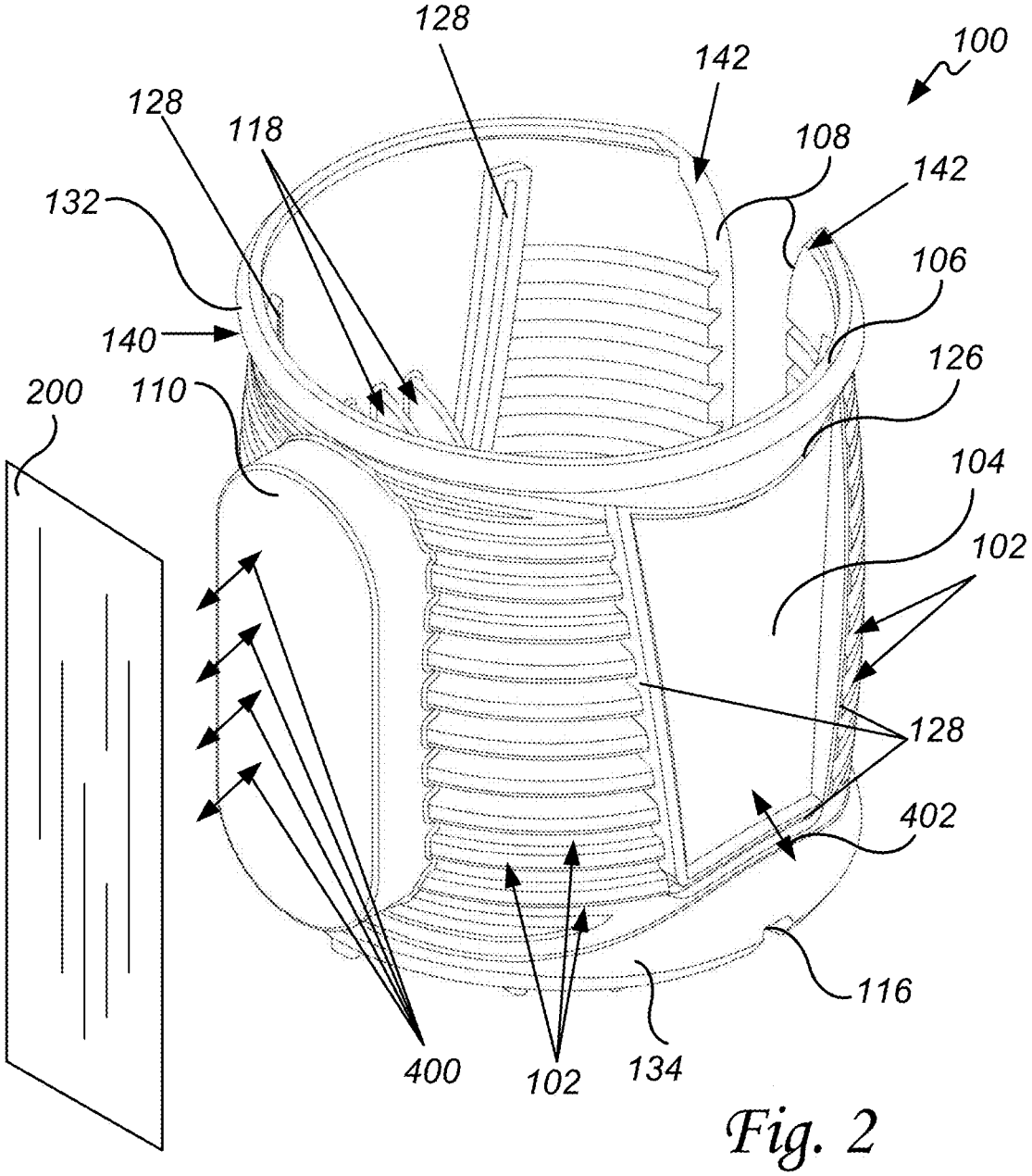
FIG. 2 illustrates one example of a perspective view of a beverage container carrier highlighting an attachment panel, a tension tab, and grooved outer sidewalls.

Referring to FIG. 2, there is illustrated one example of a perspective view of a beverage container carrier 100 highlighting an attachment panel 110, a tension tab 104, and grooved outer sidewalls 102. In an exemplary embodiment, along the rear, or posterior, support wall of cylindrical vessel receiver 132 is an attachment panel 110 that runs from the open-top rim 106 of the beverage container carrier 100 vertically towards the bottom panel 134 of the beverage container carrier 100. The attachment panel 110 is an integrally formed part of the cylindrical vessel receiver 132.

Better illustrated in at least FIG. 3, the attachment panel having one or more magnet retention slots 122 that house one or more magnets 112 which are secured in each of the magnet retention slots 122 at the time of manufacture when the two cylindrical vessel receiver 132 halves 114A and 114B are fastened together. The magnets are orientated such that the magnet force 400 secures the beverage container carrier 100 to ferrous metal objects 200. Such high-power magnets can be neodymium or other tyeps and kinds of magnets, as may be required and/or desired in a particular embodiment. The magnets provide the magnetizing force 400 that affixes the beverage container carrier to ferrous vertical surfaces.

The attachment panel 110 houses the magnets 112 that provide the force and means for the beverage container carrier 100 by way of the attachment panel 110 to be affixed to ferrous metal surfaces 200. In an exemplary embodiment, for example, and not a limitation, the beverage container carrier 100 possesses a rear vertically oriented attachment panel 110 which can be approximately 1.43 inches in width and approximately 3.50 inches in height and house the magnets 112 which provide the magnetic force 400 and means for the attachment panel 110 to be affixed to metal ferrous surfaces 200. In a plurality of other exemplary embodiments the attachment panel 110 can be different sizes.

Figure 10:
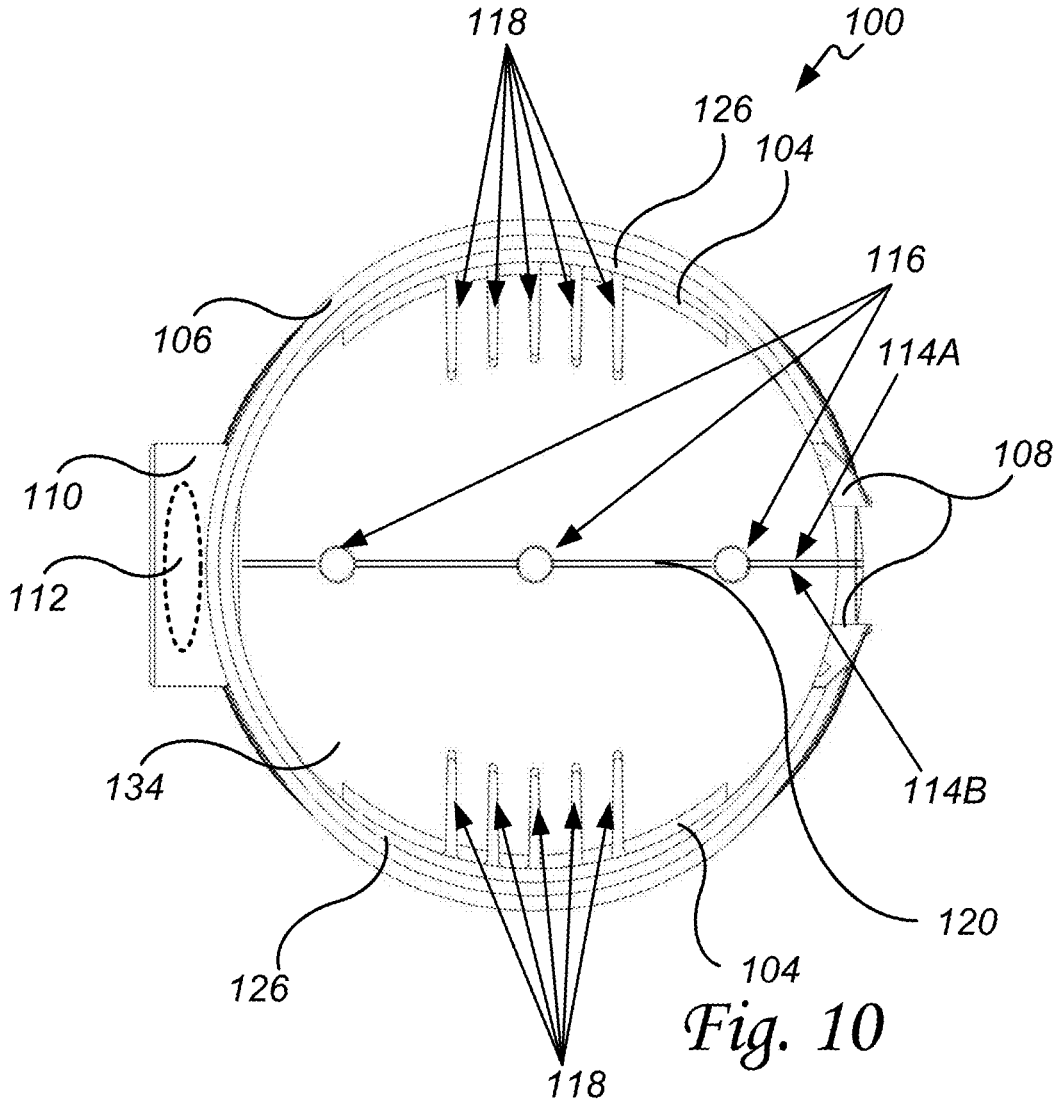
FIG. 10 illustrates one example of a top view of a beverage container carrier highlighting the tension tab having tension fins, and a bottom panel having drain holes.

In an exemplary embodiment, the exterior face of the attachment panel 110 is smooth and contains a seam 120 whereby the two halves, illustrated as 114A and 114B in at least FIG. 10, of the beverage container carrier, are attached with adhesive. In an alternative embodiment, the attachment panel 110 can have an anti-skid coating applied to mitigate slippage or rotation when attached to a vertical surface. Such anti-skid coating can be rubber or other types and kinds of anti-skid material, as may be required and/or desired in a particular embodiment.

In an exemplary embodiment, for example, and not a limitation, the plurality of magnets 112 can be configured to provide a magnetic strength in the range of 60 lb or more, as may be required and/or desired in a particular embodiment. In a plurality of other embodiment, the magnetic strength can be in other ranges above or below 60 lb.

Referring to FIG. 2, in an exemplary embodiment, located halfway between the handle slot 408 and the attachment panel 110 on both sides of the beverage container carrier 100 are flexible tension tabs 104. The tension tabs 104 are integrally formed at an attachment edge 126 proximate the open-top rim 106 of the cylindrical vessel receiver 132. The tension tab 104, with the attachment edge 126 functions as a horizontally-oriented hinge. The tension tab 104 is sized to create an air gap 128 between the cylindrical vessel receiver 132 and the sides and bottom of the tension tab 104 allowing the tension tab 104 to flex outward 402 as the beverage container 300 is inserted into the beverage container carrier 100.

In an exemplary embodiment, tension tabs 104 are disposed on opposing sides of the cylindrical vessel receiver 132, and the attachment panel 110 and the handle slot 108 are disposed on opposing sides of the cylindrical vessel receiver 132. A plurality of grooves 102 are integrally formed in the exterior surface of the cylindrical vessel receiver 132. The plurality of grooves 102 are aligned horizontally and constrained to areas between the tension tabs 104, the handle slot 108, and the attachment panel 110. In operation, the horizontally aligned groves 102 provide the user a non-slip gripping surface while using the beverage container carrier 100.

The open-top end 106 has a flared edge 140 outward to provide enhanced grasp-ability when moving or adjusting the beverage container carrier by way of the user gripping the top flared edge 140 instead of the middle of the beverage container carrier 100.

Referring to FIG. 3, there is illustrated one example of a sectional perspective of the beverage container carrier 100 which shows an internal view of one-half 114A of the beverage container carrier 100 and the tension fins 118 that are on the interior side of the tension tab 104, as well as the inside of the attachment panel 110 including the magnet cavities 122. The beverage container carrier assembly is comprised of two mirrored halves that are joined together during production with a commercial-grade adhesive.

In an exemplary embodiment, as illustrated in at least FIG. 10, the cylindrical vessel receiver 132 is formed by combining two halves 114A-B, the magnets 112 are placed within each of the magnet retention slot 122 and then both halves 114A-B are fastened together sealing the magnets 112 inside the magnetic retention slots 122.

Referring back to FIG. 3, a plurality of alignment pegs 136 mates with a plurality of alignment receptacles to ensure that the two halves 114A-B correctly fit and are aligned at the time of fastening.

Also illustrated is tension tab 104 air gap 128 around the sides and bottom of the tension tab 104 between the tension tab 104 and the cylindrical vessel receiver 132. Each half 114 forms a portion of the drain holes 116 on the bottom panel 134. When the two halves 114A-B have been fastened together the drain holes 116 are completely formed. Better illustrated in at least FIG. 10, the adhesive seam joint 120 splits the beverage container carrier into the two halves 114A and 114B traversing the drain holes 116. The drain holes 116 inside the beverage container carrier 100, on the bottom enclosed end, prevent the magnetic vessel holder 100 from retaining liquid from condensation or that leaks from the inserted beverage containers.

In addition, below the tapered tension tab 104 and tension fins 118, there are drain holes 116 where the sidewall meets the bottom panel 134. The FIG. 3 view of the beverage container carrier 100 shows half of the three drainage holes 116 that transverse the middle of the bottom of the beverage holder. The holes in this view are split in two because they are located directly along the seam 120 that joins the two halves 114A and 114B of the present invention together. The tension tab 104 can be tapered in design having a longer horizontal attachment edge than the lower horizontal bottom edge.

A plurality of tension fins 118 each having a top fin end and a bottom fin end are integrally formed on the interior surface of the tension tab 104. The tension fins 118 are curvilinear in shape wider at the bottom fin end with a taper at the top fin end that terminates at the interior surface wall of the cylindrical vessel receiver 132.

When a beverage container 300 is inserted into the cylindrical vessel receiver 132 it contacts the tension fin 118. The tension fin 118 and tension tab 104 flex outwardly 402 creating space within the cylindrical vessel receiver for different diameter sizes of the beverage container 300. In addition, tension tab 104 by way of the tension fins 118 applies retaining pressure to the beverage container 300 holding it securely within the cylindrical vessel receiver 132.

In operation, the tension tab design of the beverage container carrier effectively functions as a seamless extension of the fixed, adjacent vertical support walls of the cylindrical vessel receiver 132, except when a beverage container 300 is inserted whose maximum outer diameter exceeds the minimum inner diameter between the column of tapered fins 118 that run vertically along the inside wall of each tension tab 104. When such a larger diameter beverage container 300 is inserted into the beverage container carrier, the tension tabs respond to the lateral outward pressure exerted by the wall of the beverage container 300 on the tapered fins 118 by flexing at their respective attachment edge 126, moving outwards 402 from their resting positions.

Due to the rigid nature of the beverage container carrier 100 plastic composition and the incorporation of a horizontally-oriented attachment edge 126 for the tension tab 104, the tension tabs 104 naturally resist displacement from their resting positions and as a result, the tension tabs 104 by way of the tension fins 118 exert reciprocal lateral pressure on the inserted beverage container 300, which acts to stabilize the beverage container 300 and prevent it from sliding, rocking, or bouncing within the beverage container carrier 100.

Figure 4:
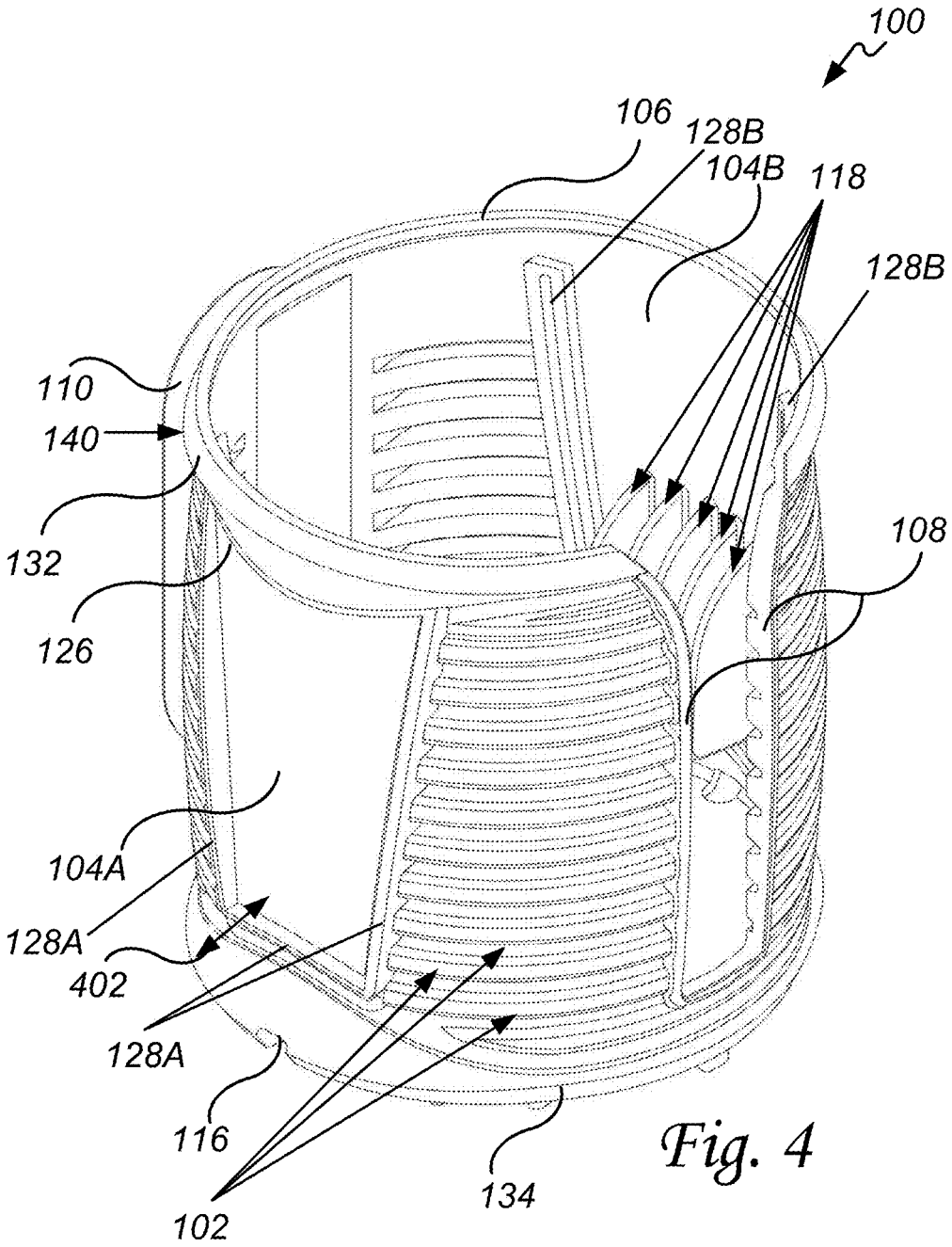
FIG. 4 illustrates one example of a perspective view of a beverage container carrier highlighting a tension tab, a grooved outer sidewall, and a handle slot to accommodate beverage containers that have handles.

Referring to FIG. 4, there is illustrated one example of a perspective view of a beverage container carrier 100 highlighting the tension tabs 104A-B, the grooved outer sidewall 102, and the handle slot 108 to accommodate beverage containers 300 that have handles. In an exemplary embodiment, a handle slot 108 is integrally formed in the front side of the cylindrical vessel receiver 132. The handle slot 108 is open proximate the open-top rim 106 for receiving the handle of a beverage container 300. The handle of the beverage container 300 slides into the handle slot 108 when the beverage container 300 is inserted into the cylindrical vessel receiver 132.

Two opposing tension tabs are shown in FIG. 4, exterior side tension tab 104A and interior side of tension tab 104B. In addition, the air gap 128A is illustrated from the exterior tension tab 104A view, and the interior air gap 128B is illustrated from the interior tension tab 104B view.

The interior profile of the tension fins 118 of the tension tab 104B are shown. In an exemplary embodiment, a plurality of beveled tension fins 118 can be vertically oriented and attached to the lower portion of the tension tab 104B interior. Not visible in the view of FIG. 4 are the tension fins associated with tension tab 104A however tension tabs 104A-B are located on opposing wall surfaces both have tension fins 118 and operate together to secure the beverage container 300.

In operation, the tension fins 118 act on the sidewalls of the inserted beverage container 300 to provide a dynamic force against the inserted beverage container 300 wall such that the inserted beverage container 300 is held in place and beverage container 300 stability is provided. The tension fins 118 are curvilinear in shape with a taper at the top fin end that terminates into the interior sidewall. The tapering of the top fin edge feature mitigates friction as tension is applied upon insertion of beverage containers 300.

Additionally, the presence of the tension fins 118 initiates outward pressure on the vertical tapered tension tabs 104A which augment the stabilizing force that holds the inserted beverage containers 300 in place. Tension tab 104B operates similarly.

Figure 5:
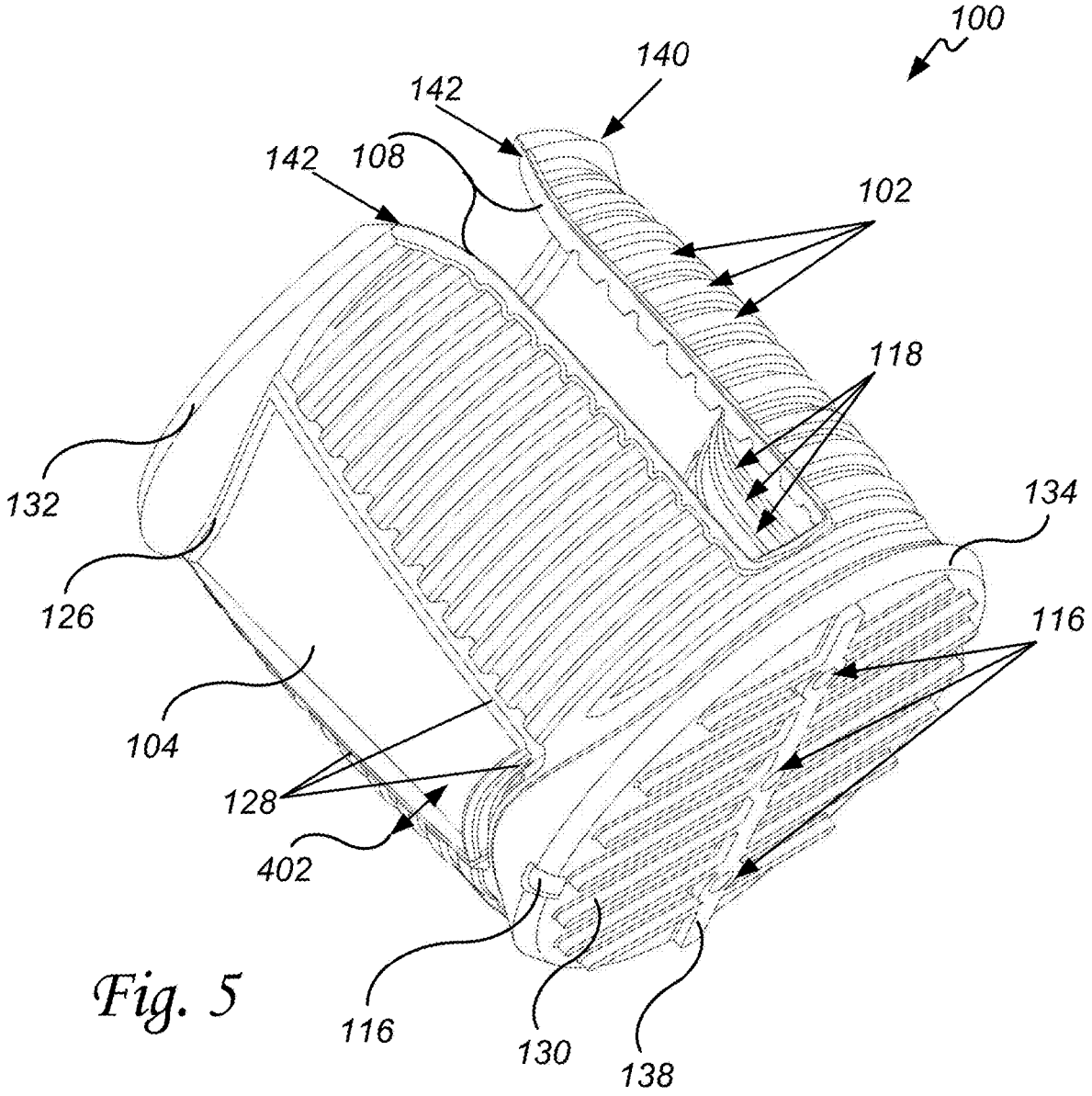
FIG. 5 illustrates one example of a perspective view of a beverage container carrier highlighting a tension tab, the beverage container carrier bottom panel having raised rib ridges and drain holes, and a handle slot to accommodate beverage containers that have handles.

Referring to FIG. 5 there is illustrated one example of a perspective view of a beverage container carrier 100 highlighting the tension tab 104, the beverage container carrier bottom panel 134 having raised rib ridges 130 and drain holes 116, and a handle slot 108 configured to accommodate beverage containers 300 should they have a handle.

An advantage in the present invention is that the beverage container carrier 100 features a handle slot vertical notch or opening located on the front face of the cylindrical vessel receiver 132. The purpose of handle slot 108 is to accommodate beverage containers 300 that are designed to include a handle that protrudes laterally from a vertical surface on the beverage container 300. In this regard, beverage container 300 with and without handles can be used in the beverage container carrier.

In an exemplary embodiment, for example, and not a limitation, the handle slot 108 can be in the range of approximately 0.75 inches in width and approximately 3.68 inches in height, with interior edges 142 that flare out toward the top near the open end 106 of the cylindrical vessel receiver 132 so that insertion of beverage containers 300 with handles can be easily accommodated. In a plurality of other exemplary embodiments, the dimensions of the handle slot 108 can be different.

The outer surface of the cylindrical vessel receiver 132 features horizontally-oriented grooves 102 to enhance the grip-ability of the unit. In an exemplary embodiment, for example, and not a limitation, the groove 102 can be in the range of 0.25 inches in width, though in other embodiments the range can be different.

In an exemplary embodiment, the cylindrical vessel receiver 132 comprises a bottom panel 134 having an interior bottom panel surface and an exterior bottom panel surface. The exterior bottom panel surface having one or more of a raised rib ridge 130 and one or more of a drain hole 116 integrally formed in the bottom of the cylindrical vessel receiver 132. Drain holes 116 allow liquid such as condensation or spillage inside the cylindrical vessel receiver 132 to egress the beverage container carrier.

An advantage, in the present invention, is that the raised rib ridges 130 elevate the bottom panel 134 so that if the beverage container carrier is sitting on a flat surface any liquid egressing from the drain holes 116 can flow away from the beverage container carrier 100. In this regard, ensuring the beverage container carrier 100 is not sitting in a puddle of condensation or spilled beverage liquid and that if there is moisture under the beverage container carrier 100 that it can easily air dry to avoid damage to any surface the beverage container carrier might be sitting on.

The raised rib ridge 130 has a bisecting ridge 138 that is configured to bisect the bottom panel 134 through which drain holes 116 are disposed. Most of the raised rib ridges 130 extends at a right angle from the bisecting ridge 138 to substantially the perimeter of the bottom panel 134. The raised rib ridges 130 are spaced across substantially the entire exterior bottom panel surface.

Figure 6:
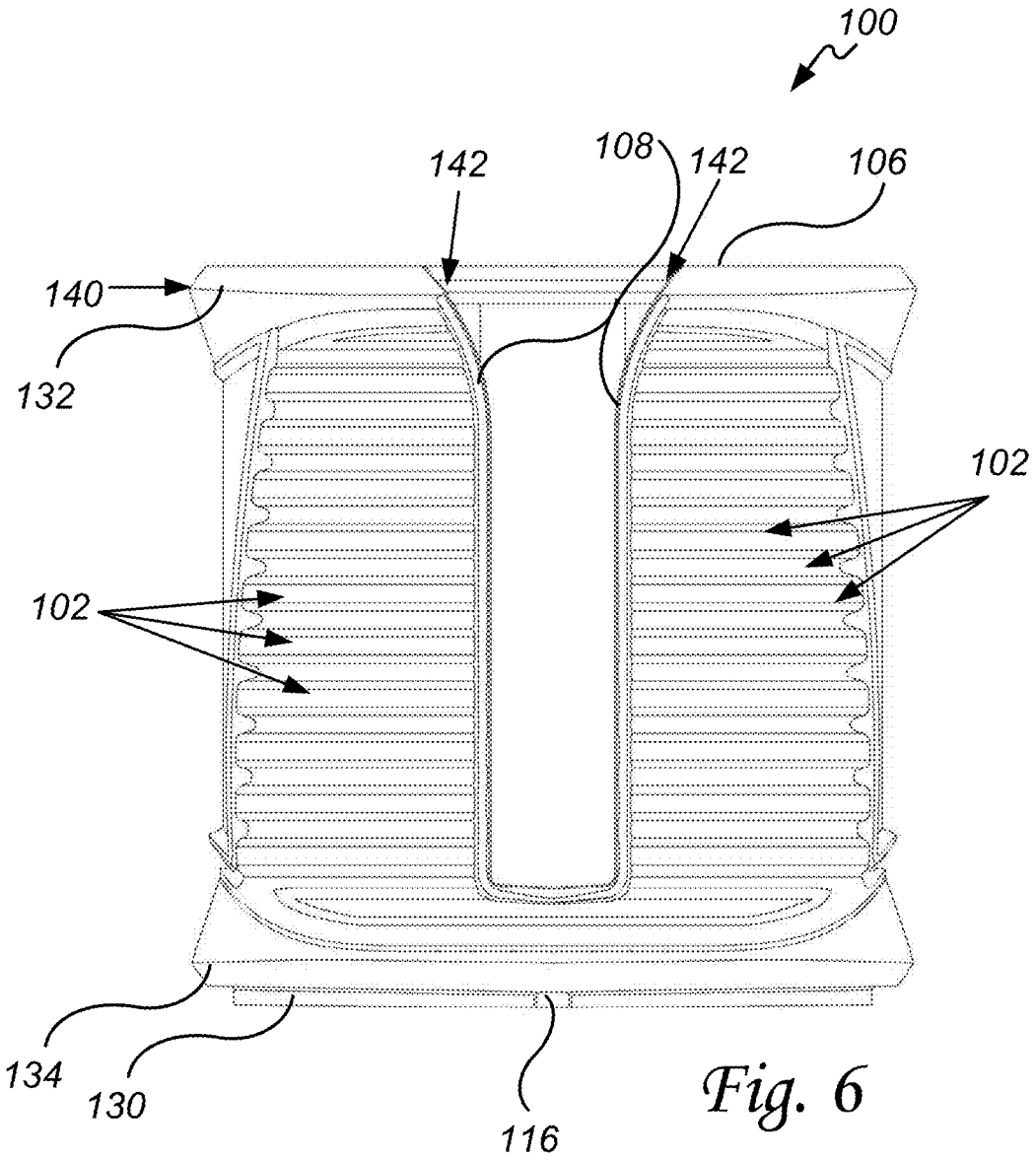
FIG. 6 illustrates one example of a front view of a beverage container carrier highlighting a grooved outer sidewall, and a handle slot to accommodate beverage containers that have handles.

Referring to FIG. 6, there is illustrated one example of a front view of the beverage container carrier 300 highlighting the grooved outer sidewall 102, and the handle slot 108 to accommodate beverage containers that have handles.

Figure 7:
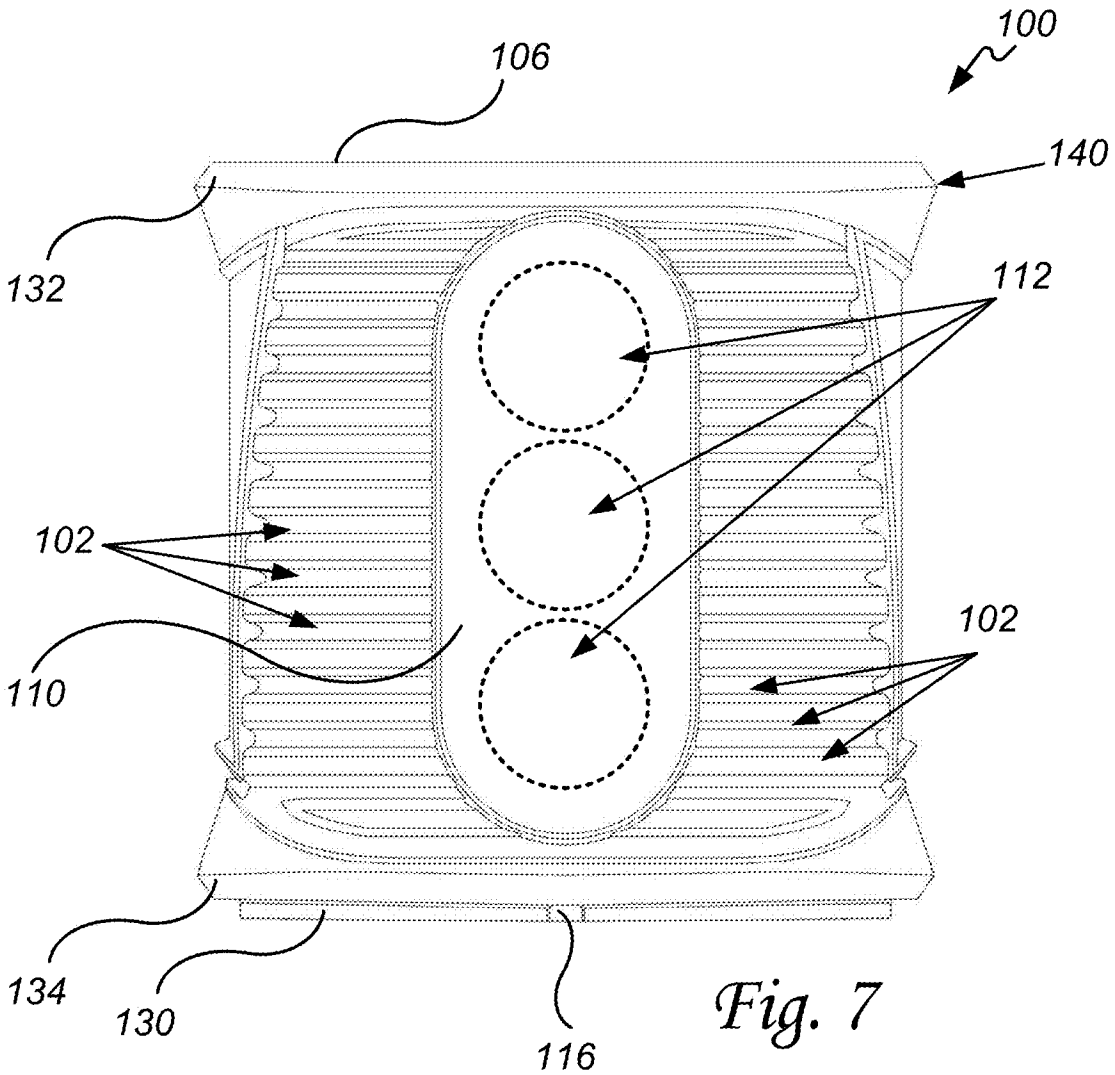
FIG. 7 illustrates one example of a back view of a beverage container carrier highlighting an attachment panel and a grooved outer sidewall.

Referring to FIG. 7, there is illustrated one example of a back view of the beverage container carrier highlighting the attachment panel 110 with magnets 112 configured within magnet retention slots 122 inside the attachment panel 110, and the grooved outer sidewall 102.

Figure 8:
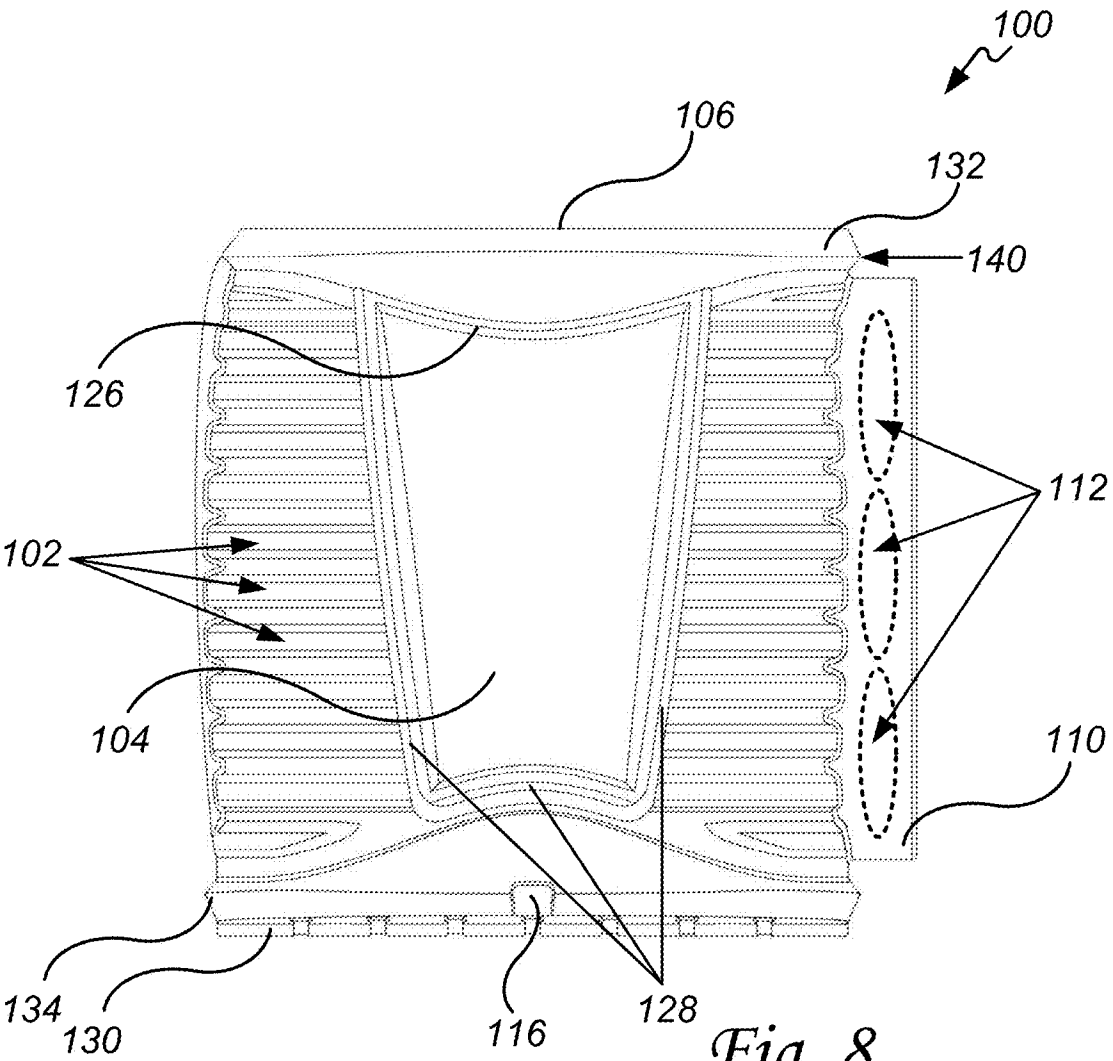
FIG. 8 illustrates one example of a right side view of a beverage container carrier highlighting a tension tab and a grooved outer sidewall.

Referring to FIG. 8, there is illustrated one example of a right side view of the beverage container carrier 100 highlighting the tension tab 104, and the grooved outer sidewall 102.

Figure 9:
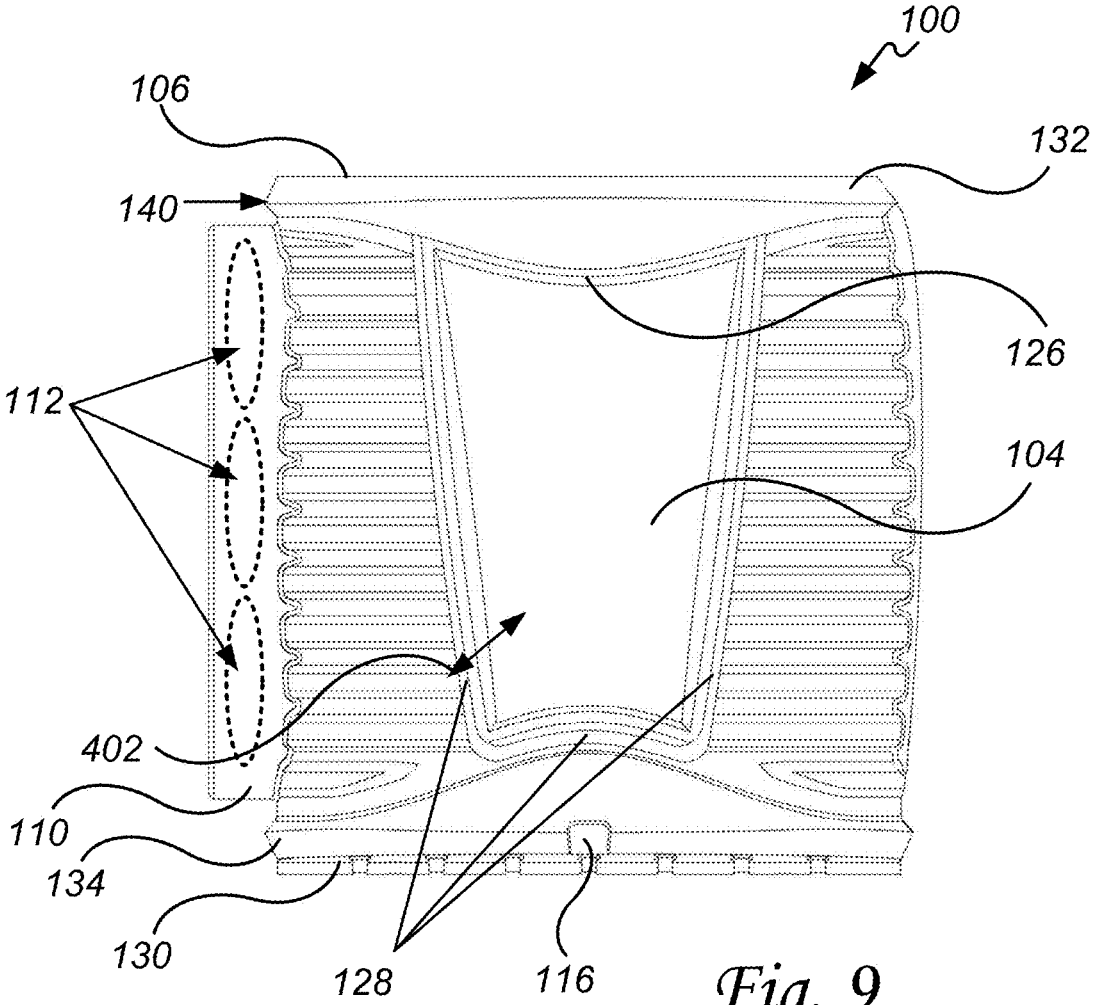
FIG. 9 illustrates one example of a left side view of a beverage container carrier highlighting a tension tab and a grooved outer sidewall.

Referring to FIG. 9, there is illustrated one example of a left side view of the beverage container carrier 100 highlighting the tension tab 104, and the grooved outer sidewall 102.

Referring to FIG. 10, there is illustrated one example of a top view of the beverage container carrier 100 highlighting the tension tab 104 having tension fins 118, and a bottom panel 134 having drain holes 116.

Figure 11:
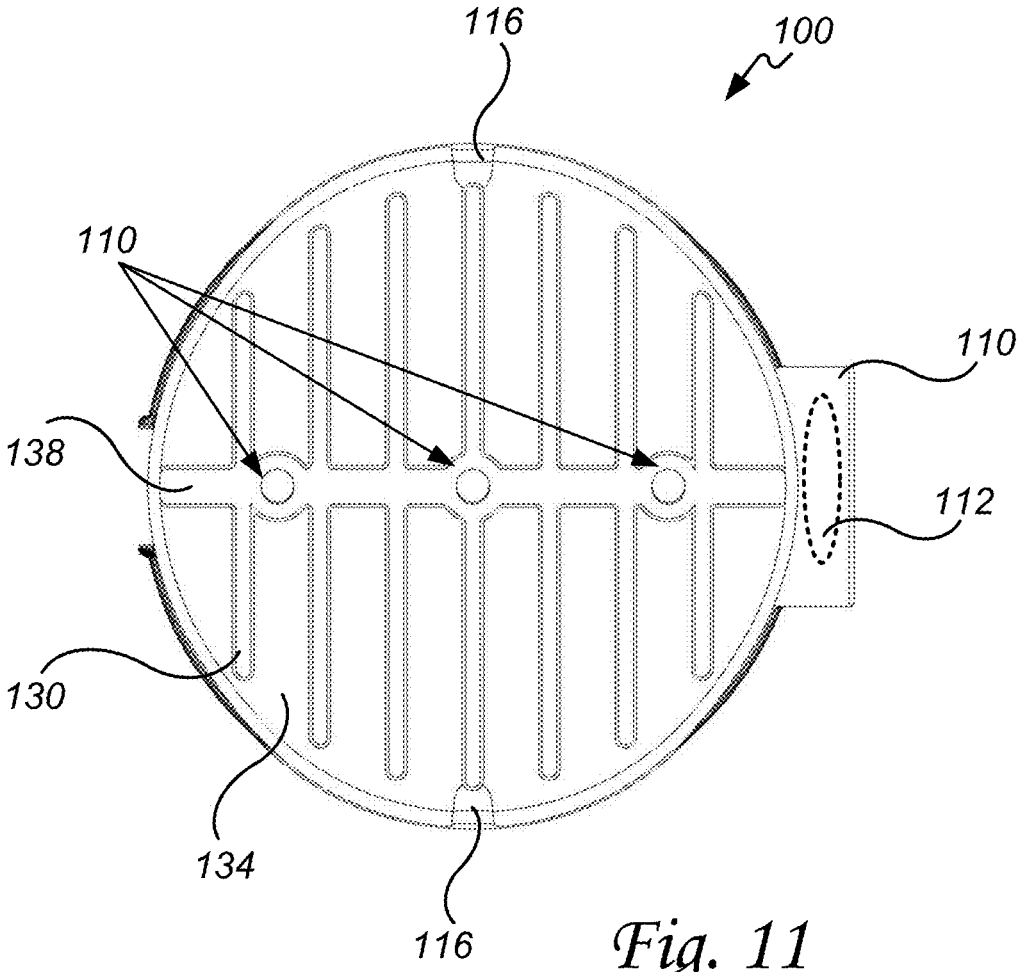
FIG. 11 illustrates one example of a bottom view of a beverage container carrier highlighting a bottom panel having raised rib ridges, a bisecting ridge, and drain holes.

Referring to FIG. 11, there is illustrated one example of a bottom view of the beverage container carrier 100 highlighting the bottom panel 134 having raised rib ridges 13, bisecting ridge 138, and drain holes 116.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A beverage container carrier comprising:

a cylindrical vessel receiver having a left side, a right side, a front side, a backside, an interior surface, an exterior surface, a bottom panel, and an open-top rim for receiving a beverage container;

one or more tension tab having an interior tab surface and an exterior tab surface, the one or more tension tab is integrally formed along an attachment edge proximate to the open-top rim of the cylindrical vessel receiver, the one or more tension tab is sized to create an air gap between the cylindrical vessel receiver and sides and bottom of the one or more tension tab allowing the one or more tension tab to flex outward; and one or more tension fin having a top fin end and a bottom fin end are integrally formed on the interior tab surface of the one or more tension tab, the one or more tension fin is curvilinear in shape and wider at the bottom fin end with a taper at the top fin end that terminates at the interior surface of the cylindrical vessel receiver, wherein when a beverage container is inserted into the cylindrical vessel receiver it contacts the one or more tension fin, the one or more tension fin and the one or more tension tab flex outward creating space within the cylindrical vessel receiver for the beverage container and applying retaining pressure to the beverage container holding it securely within the cylindrical vessel receiver.

2. The beverage container carrier in accordance with claim 1, further comprising:

a handle slot is integrally formed in the front side of the cylindrical vessel receiver, the handle slot is open proximate to the open-top rim for receiving the beverage container handle, wherein handle of the beverage container slides into the handle slot when the beverage container is inserted into the cylindrical vessel receiver.

3. The beverage container carrier in accordance with claim 1, further comprising:

an attachment panel is integrally formed in the backside of the cylindrical vessel receiver, the attachment panel having concealed one or more magnet retention slot.

4. The beverage container carrier in accordance with claim 3, one or more magnet is secured in the one or more magnet retention slot and orientated such that the one or more magnet secures the beverage container carrier to ferrous metal objects.

5. The beverage container carrier in accordance with claim 1, further comprising:

a handle slot is integrally formed in the front side of the cylindrical vessel receiver;

an attachment panel is integrally formed in the backside of the cylindrical vessel receiver; and a plurality of grooves are integrally formed in the exterior surface of the cylindrical vessel receiver, the plurality of grooves are aligned horizontally and constrained to areas between the one or more tension tab, the handle slot, and the attachment panel.

6. The beverage container carrier in accordance with claim 4, the cylindrical vessel receiver is formed by placing the one or more magnet within the one or more magnet retention slot and then fastening both halves of the cylindrical vessel receiver together sealing the one or more magnet inside the one or more magnet retention slot.

7. The beverage container carrier in accordance with claim 1, the bottom panel having one or more drain hole, an interior bottom panel surface, and an exterior bottom panel surface, the exterior bottom panel surface having one or more raised rib ridge, the one or more drain hole allows liquid inside the cylindrical vessel receiver to egress.

8. The beverage container carrier in accordance with claim 7, the one or more raised rib ridge having a bisecting ridge configured to bisect the bottom panel through which the one or more drain hole is disposed, plurality of the one or more raised rib ridge extend at a right angle from the bisecting ridge to substantially the perimeter of the bottom panel.

9. The beverage container carrier in accordance with claim 1, the beverage container carrier is made of synthetic polymer, plastic, or polyethylene vinyl chloride.

10. A beverage container carrier comprising:

a cylindrical vessel receiver having a left side, a right side, a front side, a backside, an interior surface, an exterior surface, a bottom panel, and an open-top rim for receiving a beverage container;

a handle slot is integrally formed in the front side of the cylindrical vessel receiver, the handle slot is open proximate to the open-top rim for receiving the beverage container handle, wherein handle of the beverage container slides into the handle slot when the beverage container is inserted into the cylindrical vessel receiver;

one or more tension tab having an interior tab surface and an exterior tab surface, the one or more tension tab is integrally formed along an attachment edge proximate to the open-top rim of the cylindrical vessel receiver, the one or more tension tab is sized to create an air gap between the cylindrical vessel receiver and sides and bottom of the one or more tension tab allowing the one or more tension tab to flex outward; and one or more tension fin having a top fin end and a bottom fin end are integrally formed on the interior tab surface of the one or more tension tab, the one or more tension fin is curvilinear in shape and wider at the bottom fin end with a taper at the top fin end that terminates at the interior surface of the cylindrical vessel receiver, wherein when a beverage container is inserted into the cylindrical vessel receiver it contacts the one or more tension fin, the one or more tension fin and the one or more tension tab flex outward creating space within the cylindrical vessel receiver for the beverage container and applying retaining pressure to the beverage container holding it securely within the cylindrical vessel receiver.

11. The beverage container carrier in accordance with claim 10, further comprising:

an attachment panel is integrally formed on the backside of the cylindrical vessel receiver, the attachment panel having concealed one or more magnet retention slot.

12. The beverage container carrier in accordance with claim 11, one or more magnet is secured in the one or more magnet retention slot and orientated such that the one or more magnet secures the beverage container carrier to ferrous metal objects.

13. The beverage container carrier in accordance with claim 12, the cylindrical vessel receiver is formed as two halves, the one or more magnet is placed within the one or more magnet retention slot and then both halves are fastened together sealing the one or more magnet inside the one or more magnet retention slot.

14. The beverage container carrier in accordance with claim 10, further comprising:

an attachment panel is integrally formed on the backside of the cylindrical vessel receiver; and a plurality of grooves are integrally formed in the exterior surface of the cylindrical vessel receiver, the plurality of grooves are aligned horizontally and constrained to areas between the one or more tension tab, the handle slot, and the attachment panel.

15. The beverage container carrier in accordance with claim 10, the bottom panel having one or more drain hole, an interior bottom panel surface, and an exterior bottom panel surface, the exterior bottom panel surface having one or more raised rib ridge, the one or more drain hole allows liquid inside the cylindrical vessel receiver to egress.

16. The beverage container carrier in accordance with claim 15, the one or more raised rib ridge having a bisecting ridge configured to bisect the bottom panel through which the one or more drain hole is disposed, plurality of the one or more raised rib ridge extend at a right angle from the bisecting ridge to substantially the perimeter of the bottom panel.

17. A beverage container carrier comprising:

a cylindrical vessel receiver having a left side, a right side, a front side, a backside, an interior surface, an exterior surface, a bottom panel, and an open-top rim for receiving a beverage container;

an attachment panel is integrally formed on the backside of the cylindrical vessel receiver, the attachment panel having concealed one or more magnet retention slot;

one or more magnet is secured in the one or more magnet retention slot and orientated such that the one or more magnet secures the beverage container carrier to ferrous metal objects;

one or more tension tab having an interior tab surface and an exterior tab surface, the one or more tension tab is integrally formed along an attachment edge proximate to the open-top rim of the cylindrical vessel receiver, the one or more tension tab is sized to create an air gap between the cylindrical vessel receiver and sides and bottom of the one or more tension tab allowing the one or more tension tab to flex outward; and one or more tension fin having a top fin end and a bottom fin end are integrally formed on the interior tab surface of the one or more tension tab, the one or more tension fin is curvilinear in shape and wider at the bottom fin end with a taper at the top fin end that terminates at the interior surface of the cylindrical vessel receiver, wherein when a beverage container is inserted into the cylindrical vessel receiver it contacts the one or more tension fin, the one or more tension fin and the one or more tension tab flex outwardly creating space within the cylindrical vessel receiver for the beverage container and applying retaining pressure to the beverage container holding it securely within the cylindrical vessel receiver.

18. The beverage container carrier in accordance with claim 17, further comprising:

a handle slot is integrally formed in the front side of the cylindrical vessel receiver, the handle slot is open proximate to the open-top rim for receiving the beverage container handle, wherein handle of the beverage container slides into the handle slot when the beverage container is inserted into the cylindrical vessel receiver.

19. The beverage container carrier in accordance with claim 17, the bottom panel having one or more drain hole, an interior bottom panel surface, and an exterior bottom panel surface, the exterior bottom panel surface having one or more raised rib ridge, the one or more drain hole allows liquid inside the cylindrical vessel receiver to egress.

20. The beverage container carrier in accordance with claim 19, the one or more raised rib ridge having a bisecting ridge configured to bisect the bottom panel through which the one or more drain hole is disposed, plurality of the one or more raised rib ridge extend at a right angle from the bisecting ridge to substantially the perimeter of the bottom panel.

* * * * *